United States Patent [19]

Dahl et al.

[11] 4,093,755

[45] June 6, 1978

[54] METHOD FOR MAKING A LIQUID HEAT EXCHANGER COATING

[75] Inventors: Michael M. Dahl, Lakewood; Lester D. Erb, Littleton, both of Colo.

[73] Assignee: The Gates Rubber Company, Denver, Colo.

[21] Appl. No.: 708,960

[22] Filed: Jul. 26, 1976

Related U.S. Application Data

[62] Division of Ser. No. 546,063, Jan. 31, 1975, Pat. No. 3,990,862.

[51] Int. Cl.[2] ..... B05D 1/02; B05D 1/08

[52] U.S. Cl. ..... 427/299; 165/105; 165/133; 427/422; 427/423; 428/304; 428/308

[58] Field of Search ..... 427/191, 192, 422, 423, 427/299; 165/133, 183, 105; 29/191.2 R; 428/304, 308

[56] References Cited

U.S. PATENT DOCUMENTS

| | | | |
|---|---|---|---|
| 1,268,030 | 5/1918 | McCoy | 427/423 |
| 1,578,254 | 3/1926 | Bennett | 165/133 X |
| 2,868,667 | 1/1959 | Bowles | 427/422 X |
| 3,182,361 | 5/1965 | Trimble | 427/427 X |
| 3,384,154 | 5/1968 | Milton | 165/133 X |
| 3,587,730 | 6/1971 | Milton | 165/133 X |
| 3,595,310 | 7/1971 | Burne | 165/183 X |
| 3,598,180 | 8/1971 | Moore | 165/133 |
| 3,689,987 | 9/1972 | Teague | 427/423 X |
| 3,698,936 | 10/1972 | Moltzan | 427/423 |
| 3,705,057 | 12/1972 | Kelp | 165/133 X |
| 3,753,757 | 8/1973 | Rodgers et al. | 427/191 X |
| 3,922,386 | 11/1975 | Ros | 427/192 X |

*Primary Examiner*—Ronald H. Smith
*Assistant Examiner*—Shrive P. Beck
*Attorney, Agent, or Firm*—H. W. Oberg, Jr.; Raymond Fink; Curtis H. Castleman, Jr.

[57] ABSTRACT

Flame spraying a plurality of particles of oxide film forming metal on a substrate and randomly attaching a plurality of particles to a substrate and to portions of each other, the unconnected portions between particles forming porously interconnected open cell nucleation sites capable of aiding change of state from a liquid to a gas.

7 Claims, 3 Drawing Figures

METHOD FOR MAKING A LIQUID HEAT EXCHANGER COATING

This is a division of application Ser. No. 546,063 filed on Jan. 31, 1975 now U.S. Pat. No. 3,990,862.

BACKGROUND OF THE INVENTION

The invention relates to heat exchange processes, but more particularly, the invention relates to a liquid heat exchanger interface and a process for making the same.

In a liquid heat exchanger interface for boiling liquid such as refrigerants, it is desirable from a thermodynamic viewpoint to have vaporization of the liquid take place with very little, if any, super heating of the bulk liquid. Open cell porous coatings are used on heat exchanger elements to thermodynamically affect how the liquid is vaporized.

A porous boiling surface coating in operation provides a multitude of interconnected partially liquid filled open cells which act as nucleation sites for the growth of a plurality of vapor bubbles of a boiling liquid. If the cells are not interconnected, their operation as nuclei for bubble growth is critically dependent on retaining entrapped air or vapor within the cells to initiate vaporization. However, with interconnected cells, vapor formed in a cell may activate one or more porously connected adjacent cells so that the cells are supplied with preferably a liquid film. Heat is transferred from the cell walls to the thin liquid film causing vaporization. Vapor bubbles grow and emerge from the interconnected cells and break away from the surface of the coating and rise through the liquid. Adjacent liquid flows by capillary action into the interconnected cells coating their walls. A high boiling coefficient results because only a thin film of liquid is being vaporized within the cells as opposed to super heating a thick layer of liquid to effect vaporization.

A porous coating per se does not effect a heat exchanger interface capable of promoting nucleate boiling. The coating or surface must have other certain physical requirements. For example, the cells must have a size that is capillarily responsive to the liquid to be vaporized, and the cells must be interconnected so they can be recharged with liquid after a bubble emerges. Also, the cells must be open to permit egress of vaporized liquid. The coating must provide a good conductive heating path so that sufficient transfer of heat may be made from the cell walls to liquid therein.

For example, a porous aluminum coating may be made by flame spraying round aluminum particles on a substrate using standard flame spray techniques. As disclosed in *Metal Spraying and Sprayed Metal,* W. E. Ballard, 1948, page 207, FIG. 153, a porosity of 34.3 percent is achievable with sprayed powdered aluminum. However, the cells are generally of the closed type and are not interconnected. Such a surface coating can enhance heat transfer only by an established increase in surface area. The techniques do not define an open cell coating structure where nucleation may be generated and propagated with capillary pumping of the liquid and ejection of vapor.

A prior art surface coating having the capability of establishing nucleation sites is disclosed in *Conception of Nucleate Boiling with Liquid Nitrogen,* Almgren and Smith (Paper from "Modern Developments in Heat Transfer", supplemental notes special summer program, Rohsenow and Bergles, MIT, 1968). As disclosed therein a heat transfer interface is prepared by sandblasting copper with a coarse abrasive so as to improve the mechanical bonding of flame-sprayed particles to the copper. Zinc and copper are simultaneously applied from two separate guns. The surface is etched in hydrochloric acid to remove the zinc and leave a porous, metallic surface layer of copper. Preparation of the surface requires extra steps of spraying from an additional gun and removing a sacrificial element, zinc. Structurally, the heat transfer path at the substrate copper interface is drastically reduced because particles of zinc are etched from the substrate. Also, if the zinc is not completely etched away, it may act as a contaminant to some working fluids.

U.S. Pat. No. 3,384,154 to Milton teaches a method of thermally bonding a porous layer or coating to a heat exchanger apparatus as an effective means for establishing a plurality of nucleation sites capable of promoting and sustaining nucleate boiling with very little super heat required. Although the coating as taught by Milton is quite good from the viewpoint of being capable of initiating and sustaining nucleate boiling, there are several problems or disadvantages associated with the thermal bonding by brazing, soldering, or sintering as taught in the specification and claimed. The thermal bonding of Milton requires the use of a third element which is either retained in the thermal bonding process (i.e. soldering or brazing) or sacrificed, (i.e. temporary binder or slurry). Another, but less preferred embodiment is a coating directly generated by sintering copper. The same type process would not work for the oxide film forming metals such as aluminum. The types of thermal bonding as taught by Milton are not readily applicable for economic manufacture using oxide film forming metals such as aluminum.

Soldering and brazing are akin to each other in that they both involve uniting separate metallic parts with a meltable alloy. Milton does not teach how particles can be brazed or soldered together to effect a porous coating or how the coating could be brazed or soldered to a heat exchanger surface. It can only be assumed that standard soldering and brazing techniques are used to thermally bond individual particles of the coating together and the coating or layer to the metallic surface of a heat exchanger. In either case, however, a third alloying element is involved which requires additional process steps to generate the surface. Moreover, many metals, such as aluminum, are very difficult to solder or braze especially in the size range of 40 to 400 mesh granular.

The sintering method used by Milton to thermally bond powdered metals together in such a manner to define a porous layer of coating requires the use of a sacrificial material such as isobutylene or methyl cellulose polymers. The temporary binders are mixed with the powdered material to form slurries which are used to facilitate distribution and hold the powder in place until a thermal bond is achieved and the binder is driven off. When the binder is driven off, the powders are simultaneously sintered.

It should be noted that some metal powders cannot be sintered unless special precautions are taken. These usually are the oxidized film forming metals such as aluminum. Special care must be taken to prepare such powders with additives that promote sintering or providing a reducing or inert atmosphere. In either case, a third element is involved in forming the coating which also requires additional process steps. Some metal powders such as copper may be sintered without the aid of a temporary binder. However, problems are involved in positioning and holding the powders in position for sintering and the interstices between particles are less controllable because pressure must be applied in such a sintering process. Moreover, sintering rounds and necks the interfaces between adjacent particles eliminating sharp crevices that would otherwise aid in the capillarity of the coating. Oxide film forming metal powder cannot be sintered without special process treatment. Aluminum is often sintered in an inert atmosphere or reducing atmosphere which requires special treatment or otherwise, additional process steps. When aluminum is sintered, the particles are compacted tightly against one another. Compacting precludes forming of an open celled interconnected structure which promotes nucleate boiling. Sintering aluminum particles having an aluminum oxide skin is also complicated by the fact that the temperatures required to sinter the aluminum oxide skin are considerably higher than the melting point of aluminum particles.

SUMMARY OF THE INVENTION

In accordance within the invention, a liquid heat exchanger interface or coating is provided which does not include thermal bonding by soldering, brazing or sintering. The coating is made of metal particles which are cohesively and adhesively connected at portions of each other to define a generally reticulated structure having good heat conductive properties. The unconnected portions between the particles define a plurality of porously interconnected open cells suitable for initiating and sustaining nucleate boiling in a variety of fluids such as, but not limited to, those used as refrigerants. The particles are applied to a substrate such as the wall of the heat exchanger, by means of flame spraying the particles in an oxygen rich atmosphere. The process lends itself to applying powders of the oxide film forming type without introduction of special process steps where special atmosphere elements are implemented for thermally bonding particles together.

An object of the invention is to provide an economic process for producing a heat exchanger interface capable of initiating and sustaining nucleate boiling using oxide film forming metals.

Another object of the invention is to provide a process for making a heat exchanger interface of oxide film forming metals that is capable of initiating and sustaining nucleate boiling.

A primary and more precise object of the invention is to provide a process for making an economical heat exchanger interface of aluminum.

An advantage of the invention is that oxide film forming metals may be applied in powdered form to a substrate to define a structure suitable for initiating and sustaining nucleate boiling.

Other objects of the invention are to provide a process for making liquid heat exchanger interface which produces high heat transfer coefficients when compared to conventional roughened or finned surfaces using conventional and relatively inexpensive noncritical metals.

These and other objects or advantages of this invention will become apparent after reviewing the drawings and description thereof wherein.

DESCRIPTION OF PREFERRED EMBODIMENTS

Figure 1:
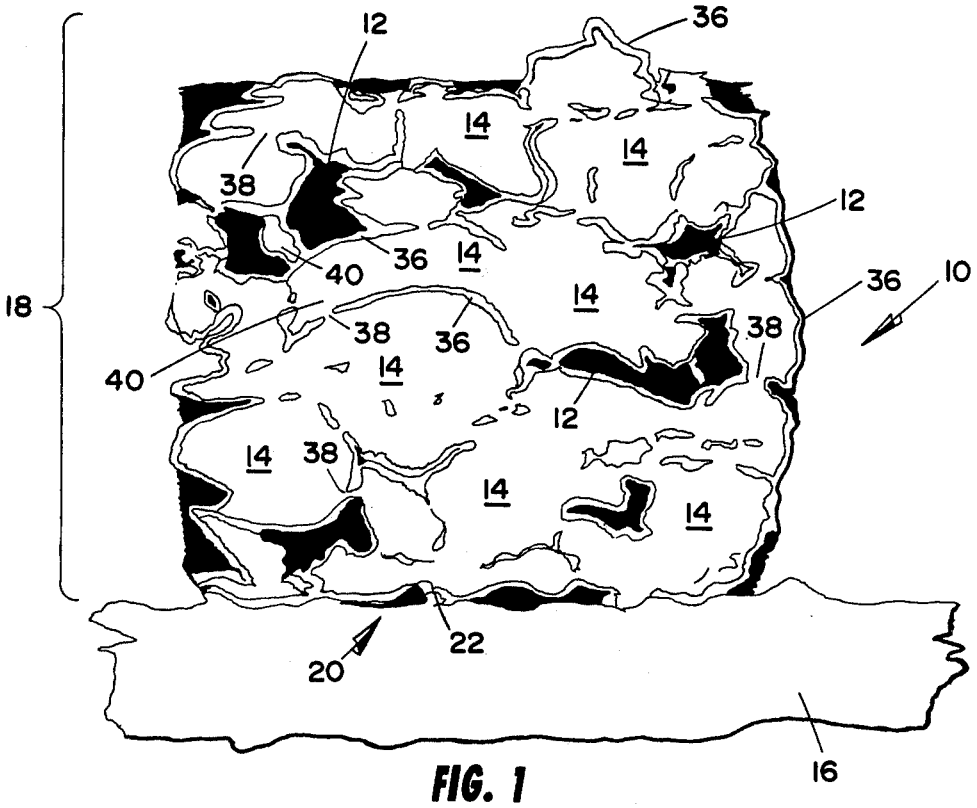
FIG. 1 is a drawing of a photomicrograph showing in cross-section a heat exchanger interface of an aluminum coating on a substrate.
Figure 2:
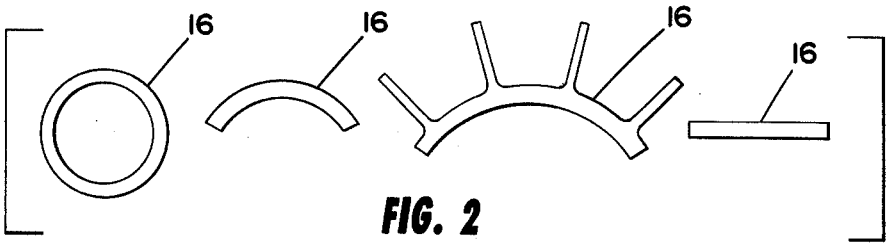
FIG. 2 is a chart showing various substrate shapes.

Referring to FIG. 1, a liquid heat exchanger interface 10 having innerconnected open cells 12 (shown in black for contrast) is prepared by flame spraying and depositing a plurality of metal particles 14 over a substrate 16 to form a coating 18. The substrate forms a wall of a typical heat exchanger across which heat is transferred in sufficient quantity to a liquid effecting vaporization thereof. The substrate 16 may take any of the typical heat exchanger shapes such as flat, curved or finned walls as shown in FIG. 2. Examples of typical heat exchanger shapes for a substrate appear in U.S. Pat. No. 3,384,154. A commonly used heat exchanger substrate is tubing. The substrate is chosen to be compatible with fluid used in the heat transfer process. The substrate is preferably highly thermally conductive for efficient transfer of heat. Three generally used substrates in heat exchanger systems are copper, stainless steel, and aluminum. Although copper may be preferable in terms of thermal conductivity, it, being a critical metal, is quite expensive. Materials such as aluminum are oftentimes chosen as an economic substitute even though generally a larger substrate surface area may be required.

The coating may be applied directly to the substrate. However, it is preferred that the surface be cleaned prior to application of the coating and it is more preferred that the surface be roughened 20 prior to application of the coating 18. The roughened surface of the substrate provides means for mechanically interlocking 22 the coating to the substrate as well as increasing the effective surface area of the substrate. A roughened surface also establishes a plurality of multidirectional heat paths that are beneficial in the operation of the coating.

In flame spraying or metallizing of metallic powders, the main variables affecting porosity of the deposit include: gas balance; spray distance and angle; type of powder (including particle size distribution, type of alloy, ductility and melting point); type of fuel gas; powder feed rate; substrate surface temperature; presence of contaminants; shape of substrate (e.g. flat or curved); and type of spray nozzle used to apply the coating. With standard metallizing techniques, dense coatings result as the particles flatten on impact with the substrate and with each other in a "fish-scale" like manner. Some amount of porosity is usually present in these coatings such as may be caused by contamination of the powdered material being sprayed or the substrate. However, these coatings generally do not have a high degree of interconnectedness between pores or cells and a total void volume in average pore size is relatively small. In contrast, the coatings of the invention are provided that are capable of initiating and sustaining nucleate boiling of a liquid because of structure which has porously interconnected open cells where nucleation is generated and propagated with capillary pumping of the liquid and ejection of the vapor.

It has been determined that the oxidizer-fuel gas balance is of prime importance when producing coatings of oxide film forming metal that have porously interconnected open cells which are capable of effecting nucleate boiling.

Figure 3:
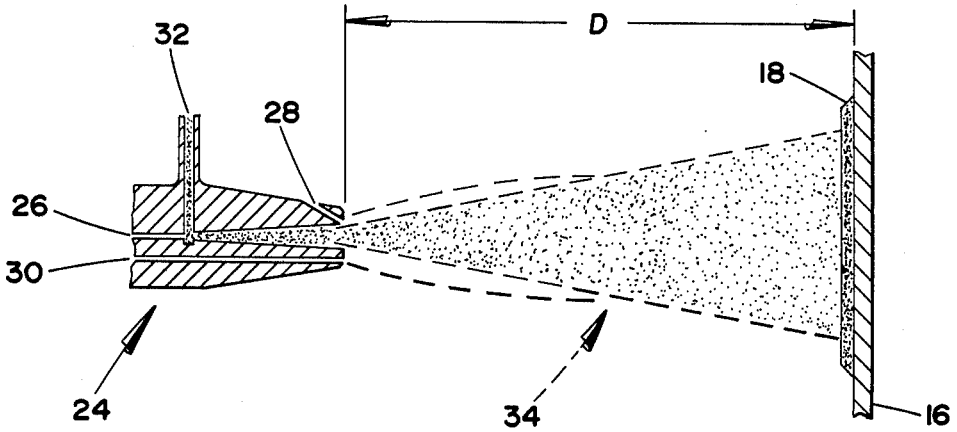
FIG. 3 is a schematical representation emphasizing principle parts of the process of the invention.

Referring to FIG. 3 a typical spray nozzle 24 is used to apply the metallic powders. The spray nozzle includes a plurality of passageways for fuel aspiration 26, air aspiration 28, oxidizer gas 30, and powder feed 32. Fuel as a carrier gas is mixed with the metal powder prior to being emitted from the nozzle and combusted with an oxidizing gas. Air is aspirated by and mixes with the fuel and oxidizer to take part in the combination process.

For purpose of illustration, a method for making a liquid heat exchanger interface of aluminum is discussed. The oxidizer-fuel gas balance is adjusted for oxide gas in excess of the stoichiometric value where acetylene ($C_2H_2$) is used for the fuel and oxygen ($O_2$) is used for the oxidizer. Combustion of the gases takes place outside the nozzle 24 where they expand into a high velocity stream 34. The aluminum particles are carried along with the aspirating air and heated in the burning gases. It is theorized that the oxygen rich atmosphere, in which carbon is present, forms an oxidized film 36 which encapsulates each aluminum particle 14. The oxide film 36 has a higher melting point than the aluminum particle and the surface tension of the oxide film keeps the particle intact during its flight for impact with the substrate or other particles. It is further believed that the oxide film prevents the particles from completely flattening upon impact with the substrate or other particles.

The distance D from the nozzle to the substrate is also of importance as it establishes a time of flight for the particle wherein it is heated and oxidized. A distance of generally 12 inches has proved appropriate for aluminum. Upon impact, a plurality of the particles are deformed by the roughened substrate and mechanically interlocked 22 therewith. As additional particles are deposited over those particles already deposited on the substrate, they are not completely flattened (i.e. generally unflattened) on impact. It is postulated that some of the oxide film breaks on impact allowing molten aluminum between some particles to fuse or cohere with each other at what is defined as a liquid frozen interface 38. Other particles mechanically interlock with each other. The oxide coating also helps join the particles together as an adhesive. Thus, each particle is believed to be cohesively and adhesively attached to portions of one another. Where the oxide film breaks, a good heat path is formed in the generally reticulated structure. The aluminum is sprayed to sufficient depth over the substrate to form a coating 18 that will readily initiate and sustain nucleate boiling. As brought forth in prior art, the minimum thickness of the coating should be at least two or more particles deep. Table I summarizes the flame spraying or metallizing conditions of the above example in producing an aluminum surface on an aluminum substrate to define a heat exchanger interface.

TABLE I

| |
|---|
| Fuel: Acetylene ($C_2H_2$) |
| Oxidizer: Oxygen ($O_2$) |
| Flow rate, cubic feet per hour: |
| Fuel: 16–26; (17 preferred) |
| Oxidizer: 23–47; (38.5 – 47 preferred) |
| Pressure, psig: Fuel 10; Oxidizer 15 |
| Spray Distance: 12 inches |
| Carrier Gas: Fuel |
| Aspirating Gas: Air |
| Type of Powder: 99+% aluminum, −170 to +325 mesh |
| Powder Feed Rate: 3.75 pounds/hour |

FIG. 1 is illustrative of a substrate consisting of a 1 inch diameter tube. The coating was applied to a depth of 12–15 mils. Of course, the coating may be applied to greater or lesser depths. As shown, a plurality of generally unflattened particles are attached to portions of each other. The attachment points are varied in nature. Some of the particles are mechanically interlocked 40 with each other while other particles are cohesively connected with each other where the oxide film is broken 38. Others are adhesively attached to each other by the oxide film 36. It is theorized that particles in flight are either in a molten or plastic state. On impact with the substrate or each other, the oxide film of some of the particles break joining them cohesively together at a liquid frozen interface which establishes a conductive heat path through adjacent particles. The mechanically interlocked particles also have a good conductive heat path. Together, the attached particles define a reticulated heat distribution structure.

It is believed that the particles are covered with a substantially homogeneous oxidized surface 36. The unattached portions between particles define a plurality of porously interconnected open nucleation cells 12. The cohesive attachments of particles at the liquid frozen interfaces define a reticulated heat distribution structure that aids the nucleation boiling process.

The FIGS. do not readily show the interconnectedness of the nucleation cells which are shaded in black for contact with the particles. The interconnectedness of the cell is not readily apparent because the FIGS. illustrate a two-dimensional cross-section while the interconnectedness between cells occurs in three dimensions. The interconnectedness of the cells is perhaps best described in terms of exhibited physical properties.

The recommended fuel for standard flame spraying of aluminum particles is hydrogen. However, it has been determined by experimentation that hydrogen gas will not work under the above conditions as the aluminum particles are substantially completely oxidized to aluminum oxide. Inexplicably, the presence of carbon in the oxygen rich combustion zone appears to protect the particles from over oxidization permitting the coating of the invention to be produced.

The surface produced by spraying aluminum was analyzed to categorize the elements present in the coatings. Aluminum oxide ($Al_2O_3$) types gamma and chi, and carbon, thought possibly to be in the form of aluminum carbide ($Al_4C_3$), or free carbon, were found in the coatings.

To experimentally determine the heat transfer capability of the heat exchanger interface as above described, a 1 inch diameter substrate tube with a coating thickness ranging between generally 10 to 15 mils was immersed in acetone to establish its capillarity. After 4 hours at ambient temperature and pressure the acetone rose at least 12 inches above the free liquid surface. This of course corresponds to an euivalent pore radius of 0.8 mils.

Prior art establishes that an average pore radius of less than 4.5 mils will have a pronounced influence on the ability of a surface to promote nucleate boiling. Although equivalent pore radius is useful, care must be taken not to over-emphasize its meaning in establishing criteria for nucleate boiling for a variety of fluids over a variety of temperature ranges. For example, if all cells had a pore radius of 4.5 mils the coating would be effective for only limited thermal conditions rather than for a range of thermal conditions. There should be a good distribution of cell size so that a variety of fluids can be used over a variety of temperature ranges if so desired. The average pore radius of the above example is in the approximate range of 0.3 to 6.0 mils.

While pore radius is an effective tool for preliminarily predicting expected performance of a coating, the coating must be tested under controlled conditions to determine its ability for promoting nucleate boiling.

Aluminum powder was flame sprayed in accordance with the invention on one inch diameter tubes of copper and aluminum. Comparative tests were conducted to evaluate performance of the sprayed coatings with bare tubes. Both tubes were immersed in trichlorotrifluoroethane at a pressure of 12.3 psia. Water was pumped through the tubes as a medium with a heat coefficient of 975 BTU/hr-FT$^2$ – ° F to effect boiling of the trichlorotrifluoroethane (for example, refrigerant 113). Chart A clearly shows the difference in heat flux in terms of BTU/hr/FT$^2$.

CHART A

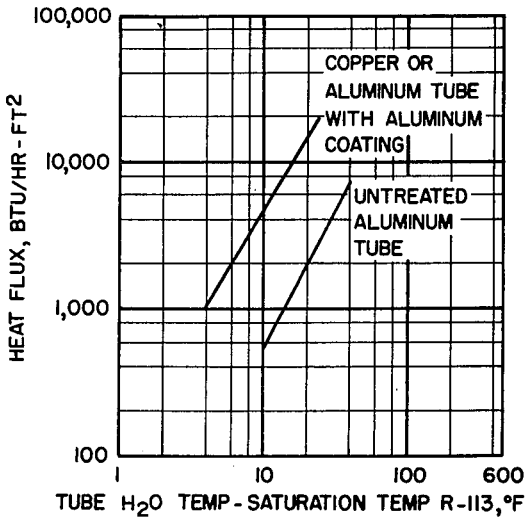

Similarly, the aluminum tube was immersed in water while steam was circulated through the tube. The boiling coefficient was calculated and compared to the heat flux for bare and sandblasted copper tubes. Chart B is illustrative of the results.

CHART B

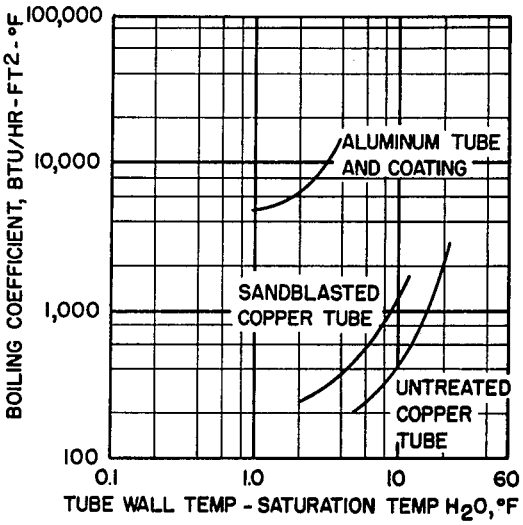

Additional Species

Other oxide film forming metals which may be sprayed using the above described technique are iron, stainless steel, nickle, titanium, silver, tin and zinc. The exact gas conditions and spray distance must be adjusted to meet the requirements of the particular metal. Also, any desirable material may be used as the substrate, provided that it is not adversely affected by the flame spraying process. Materials with a temperature resistance of generally at least 400° F. for a few seconds are satisfactory. Examples of such materials are: iron, stainless steel, nickle, titanium, silver, tin, zinc, copper, brass, glass, plastic and rubber.

The foregoing detailed description was made for purposes of illustration only and is not intended to lend the scope of the invention which is to be determined from the following claims.

What is claimed is:

1. A method for making a liquid heat exchanger coating comprising the steps of:

heating a plurality of powder particles of oxide film forming metal in an oxygen rich atmosphere and forming a metallic oxide film on the particles;

moving the particles with a stream of oxygen rich gas while simultaneously heating a plurality of the particles to at least a plastic state and some of the particles to a molten state;

impacting a plurality of the particles against a metallic substrate and against themselves partially deforming, securing and mechanically interlocking a plurality of the particles to the substrate and to portions of each other, breaking the oxide film and fusing some of the molten particles to portions of each other and forming unconnected portions between a plurality of particles that define a plurality of open nucleation cells and the unconnected portions also forming porous interconnections between nucleation cells.

2. The method of claim 1 comprising burning generally 17 cubic feet per hour of acetylene with generally 38.5 cubic feet per hour of oxygen with air aspiration to constitute the steps of heating the particles and forming an oxide film.

3. The method of claim 1 and further including the step of roughening the substrate prior to the step of heating the particles.

4. The method of claim 2 wherein during the step of moving, the particles travel generally 12 inches before impacting.

5. The method of claim 2 wherein the particles are aluminum of about −170 to +325 mesh.

6. The method of claim 5 which further comprises during the step of moving, the step of flowing the powder at a rate of about 3.75 pound per hour.

7. The process as set forth in claim 1 wherein during the step of heating, the powdered metal particles are exposed to an oxygen-rich atmosphere in which carbon is present.

* * * * *